United States Patent [19]

White et al.

[11] 4,313,043

[45] Jan. 26, 1982

[54] COMBINATION MICROWAVE OVEN AND EXHAUST VENT AND INSTALLATION MOUNTING METHOD THEREFOR

[75] Inventors: James A. White, Louisville; Frank L. Rice, Jeffersontown, both of Ky.

[73] Assignee: General Electric Company, Louisville, Ky.

[21] Appl. No.: 935,433

[22] Filed: Aug. 21, 1978

[51] Int. Cl.[3] ..... H05B 6/64

[52] U.S. Cl. ..... 219/10.55 R; 126/299 D; 312/242; 312/245; 312/278; 248/674

[58] Field of Search ..... 126/299 D, 21 A; 219/10.55 R, 10.75; 248/674; 312/245, 257 R, 214, 278; 362/92, 226

[56] References Cited

U.S. PATENT DOCUMENTS

| | | | |
|---|---|---|---|
| 1,473,817 | 11/1923 | Gorsline | 312/257 R |
| 1,492,382 | 5/1924 | Smith | 126/21 A |
| 2,275,772 | 3/1942 | Koch | 126/299 D |
| 3,089,479 | 5/1963 | Perl | 126/21 A |
| 3,180,331 | 4/1965 | Jenn et al. | 126/21 A |
| 3,384,067 | 5/1968 | Rawald et al. | 126/21 A |
| 3,514,577 | 5/1970 | Dills | 219/400 |
| 3,514,578 | 5/1970 | Dills | 219/400 |
| 3,576,417 | 4/1971 | Tingley | 219/10.55 |
| 3,654,417 | 4/1972 | Javes et al. | 219/10.55 |
| 3,783,219 | 1/1974 | Tateda | 126/198 |
| 3,818,171 | 6/1974 | Miller et al. | 219/10.55 |
| 3,973,551 | 8/1976 | Caselani et al. | 126/21 A |
| 4,011,803 | 3/1977 | Pfaffinger | 98/115 K |
| 4,254,450 | 3/1981 | White et al. | 362/92 |

OTHER PUBLICATIONS

Ad. Brochure by Litton Corp. "A Metal Shelf Above Your Range".

*Primary Examiner*—James C. Yeung

*Attorney, Agent, or Firm*—Radford M. Reams; H. Neil Houser

[57] ABSTRACT

A combination microwave oven and exhaust vent comprising a support assembly and a microwave oven operating module. The support assembly includes an open sided support enclosure into which the operating module is slidably inserted. The support assembly is initially mounted in the position above a countertop or cooking surface and the module is inserted thereinto to complete the mounting process.

7 Claims, 5 Drawing Figures

COMBINATION MICROWAVE OVEN AND EXHAUST VENT AND INSTALLATION MOUNTING METHOD THEREFOR

BACKGROUND OF THE INVENTION

This invention relates to a combination microwave oven and ventilating hood. More particularly, this invention is directed to a combination microwave and ventilating hood adapted to be positioned in the space above an electric gas range or cooking surface normally occupied by a ventilating hood alone.

In most present day kitchens, the principal cooking appliance consists of an electric or gas range. Such ranges normally include a horizontally disposed surface having a plurality of electric or gas cooking units on which a food containing vessel is supported during the cooking process. In order to exhaust odors and smoke attendant to this cooking process there is usually provided, directly above the cooking surface, a ventilating or exhaust hood. This ventilating or exhaust hood is usually supported in the midst of storage cabinets and is generally of standard dimensions.

In recent years, there has been a growing demand for microwave ovens for use in kitchens as a supplement to electric and gas ovens. As a result of this demand, the so-called countertop microwave oven has been developed and made widely available. This type of oven has, however, typically required the use of already limited countertop space in the typical home kitchen. This latter disadvantage has been one factor in slowing the growth of the countertop microwave oven market and has generally made the addition of such an oven less desirable to housewives.

The above disadvantage has been substantially overcome by the provision of a novel combination microwave oven and ventilating hood, described in greater detail hereinafter, which utilizes the space over a kitchen range normaly occupied by the ventilating hood alone. In addition, the invention is particularly directed to the features of such a combination product which particularly adapt it to easy and facile installation by one person.

More particularly, it is desirable for kitchen appliances to be easily installed by one person. Heavy appliances which require two installers to carry or mount significantly increase the ultimate cost of the appliance to the purchaser. With regard to appliances which are to be mounted to a wall or hung underneath a cabinet or other support, the problem arises when it is required that a second person be present to physically hold or position the appliance in place while the mounting bolts or fastening devices are inserted by the other person.

One of the most common methods of attaching appliances to the walls includes the use of a bolt or screw which projects through the appliance into the wall or support structure. Unfortunately, if an appliance is heavy, a single installer is forced to lift and position the appliance with one hand while attempting to secure it by inserting and driving a screw with the other. Over and above the difficulty of this procedure, this often results in misalignment of the appliance with the surrounding support pieces or, worse, an insecure mounting for the appliance. Gaps between adjacent pieces become greater and are unsightly. The heavier the appliance, the greater the problem since the time required to properly drive a screw or insert a bolt may be greater than the time the installer can physically support the weighty appliance. Sometimes the appliance, due to the awkwardness of the mounting procedure, is installed in a skewered position and thereby fails to operate properly or operates less effectively.

The above considerations all increase the desirability of a mounting system for an appliance which permits installation by a single installer and, furthermore, which assures, by the nature of the arrangement, a secure and properly aligned appliance when installed.

OBJECTS AND SUMMARY OF THE INVENTION

It is therefore an object of the present invention to provide a combination microwave/exhaust vent which can be installed in a facile manner by one installer.

A further object is to provide a combination product of the above-noted type which is easily and accurately aligned automatically upon installation.

A still further object is the provision of a combination product which can be easily installed either to an overhanging wall or to a vertical wall.

These and other objects are accomplished by the provision of a combination microwave oven and exhaust vent which includes a support assembly and an oven module. The support assembly is first mounted to a support structure; then the module is inserted into the previously-mounted support assembly in order to complete the installation of the combination product.

BRIEF DESCRIPTION OF THE DRAWINGS

These and other objects, features and advantages of the invention which will now become apparent upon a reading of the following detailed description taken in conjunction with the accompanying drawings, in which.

DESCRIPTION OF THE PREFERRED EMBODIMENT

Figure 1:
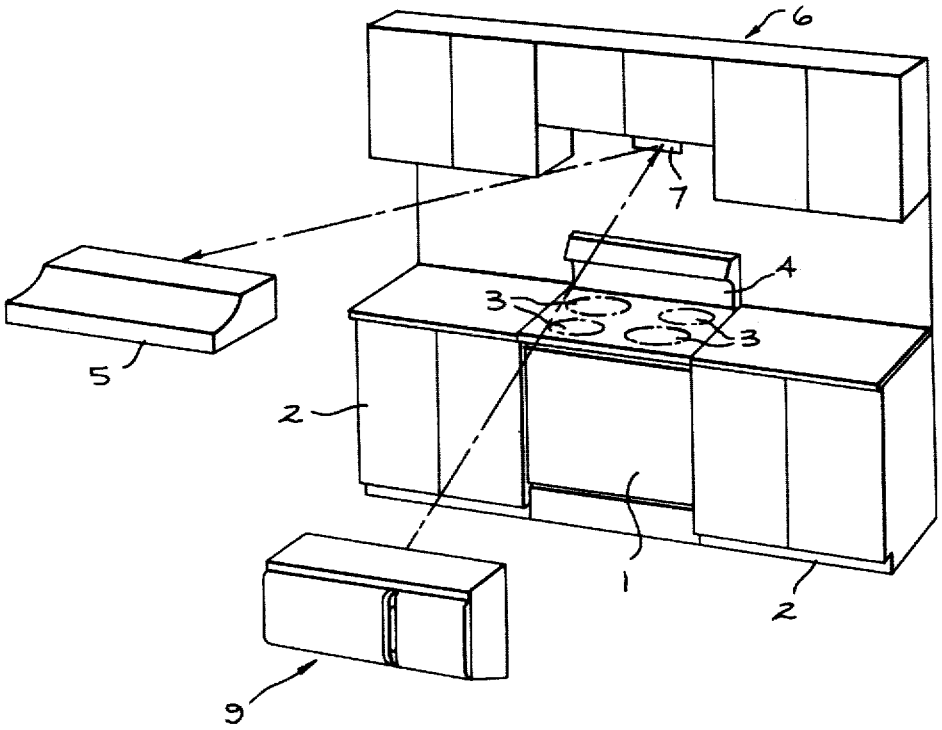
FIG. 1 is a perspective view of a conventional home kitchen cooking appliance arrangement showing the conventional exhaust hood displaced from its normal position and illustrating the installed position of the novel combination structure of this appliance.

Referring to the drawings, FIG. 1 shows a typical kitchen cooking arrangement including a range 1 located between adjacent floor cabinets 2. The range includes a plurality of surface heating units 3 on the top surface thereof and an upstanding splash guard 4 at the rear thereof. In the typical installation an exhaust hood or vent 5 is located directly above the surface heating units 3 and is nestled among a series of wall-mounted cabinets 6. The hood includes an air-moving device and suitable air ducts which cooperate with an exhaust opening 7 and associated ducts (not shown) to move odorous air from the vicinity of the cooking units to the exterior of the kitchen. An alternative arrangement, which is used when an exterior leading duct is not available, is to circulate air from the range cooking surface through an odor and particulate removing filter and return it to the kitchen. Hoods of this type may also include a light to illuminate the cooking surface. In either case, the hood occupies the same space directly above the range.

This invention is directed to the provision of a combination microwave oven and exhaust vent illustrated generally as 9 in FIG. 1, which may be inserted in place of the hood 5. The combination microwave oven and vent assembly performs the functions normally provided by the hood 5 referred to hereinbefore, but in addition provides a microwave cooking appliance. This dual-function appliance is provided by a structure which occupies the same general space previously taken by the single-function device or hood. In particular, this application is directed to the features of such a combination structure which permit easy installation thereof by a single installer and provide quick and accurate alignment of the structure in the mounted position.

Figure 2:
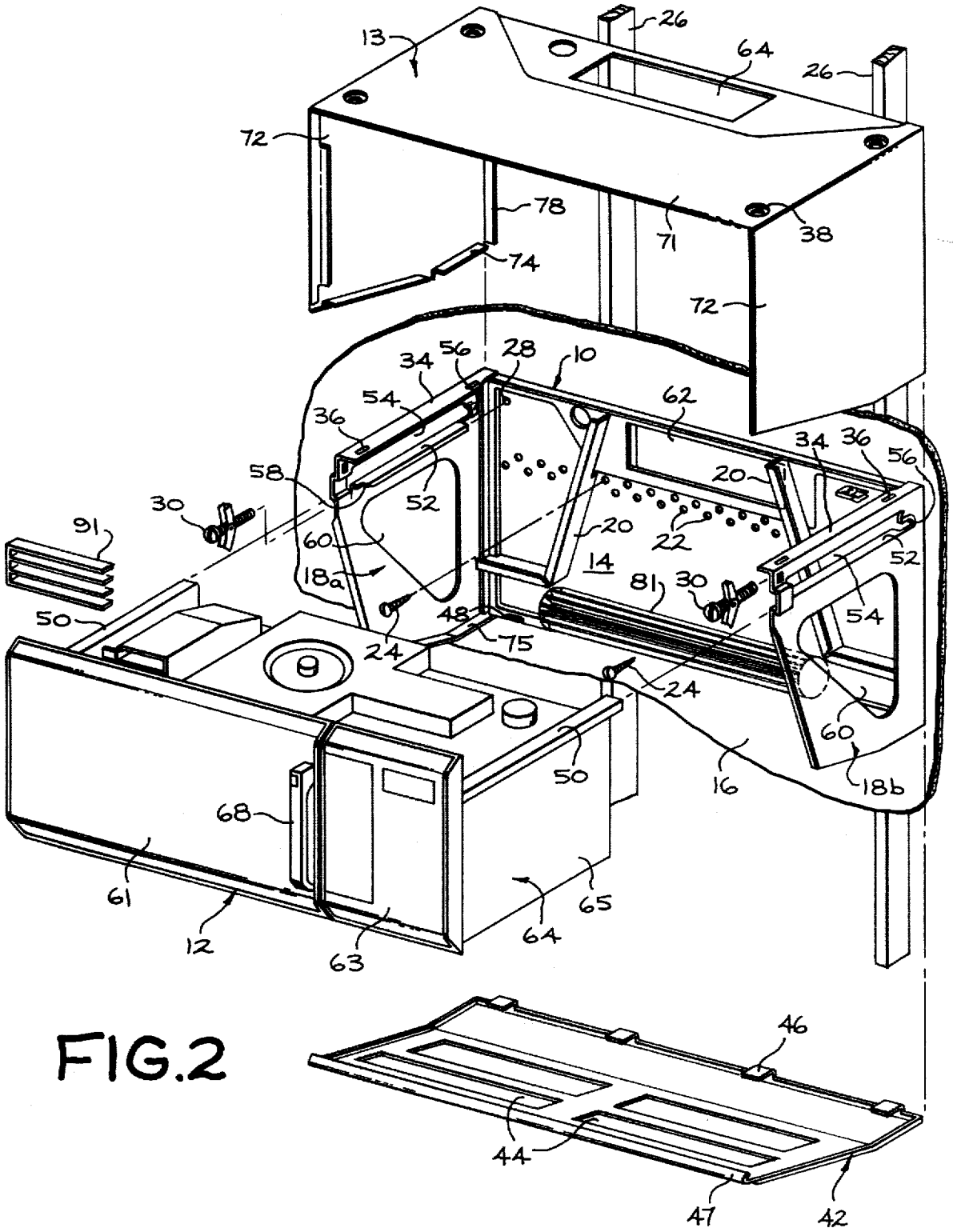
FIG. 2 is an exploded perspective view showing the details of the support assembly and oven module of the invention.

Referring now to FIG. 2, the invention is seen to comprise a support assembly 11 which includes a main support member 10, a cover member 13 and a bottom closure 42 which jointly form an open-sided enclosure into which an oven module 12 is supportably inserted.

The main support member 10 provides essentialy the entire support for the arrangement, and for this purpose is constructed of a relatively heavy gauge sheet metal. The main support member 10 includes a back wall 14, adapted to fit substantially flush against a conventional wall board 16 and a pair of appliance supporting integral sidewalls 18*a* and 18*b*. The supporting sidewalls 18*a* and 18*b* extend frontwardly from the back wall 14 and are generally perpendicular thereto. The distance between the spaced sidewalls 18*a* and 18*b* is selected to be slightly smaller than the width of the space occupied by the exhaust hood 5, in FIG. 1. The exterior or outward faces of the back wall and sidewalls are generally planar so as to present a generally flat surface for abutment in close contact with adjacent vertical walls.

The sidewalls 18*a* and 18*b* are provided with triangular openings or voids 60 for the purpose of lightening the weight and consequently the cost of the member 10 without substantially reducing its support capability. The backwall 14 has a rectangular opening 62 to provide a vent path out of the assembly along the back thereof, the opening 62 being either blocked by a suitable covering piece (not shown) or brought into air communication with a range exhaust flue or conduit for venting to the exterior.

The back wall 14 contains on its interior surface a pair of raised walls or ribs 20 for enhancing the strength and rigidity thereof. The ribs 20 also perform the function of directing exhaust air through the structure, as described in greater detail in concurrently-filed application Ser. No. 935,436, now abandoned, but continued as Ser. No. 142,943, filed Apr. 23, 1980, in the joint names of James A. White, Frank L. Rice and Walter E. Lewis, and entitled *VENTILATION SYSTEM FOR COMBINATION MICROWAVE OVEN AND EXHAUST VENT*, which disclosure is hereby incorporated by reference.

Multiple rows of holes 22 extend across the back wall 14 through selected ones of which at least one lag screw 24 or other suitable threaded fastener can be inserted to securely mount the assembly to the wall board 16 and to at least one wall support member or stud 26. A pair of holes 28 located in the upper right and left hand corners of the back wall 14 permits the main support member 10 to be further secured to the wall board 16 with suitable fasteners such as a pair of toggle bolts 30. By selecting fasteners of suitable type and size, we have found that the conventional wall board and studs found in many modern homes will safely support appliance loads of up to 200 pounds. By comparison, the combination microwave oven and vent structure which we contemplate installing weighs between 90 and 100 pounds which is well below the safe maximum support capability of a single standard 2×4 inch wall stud.

In order to provide support for the oven module 12 when inserted into the support assembly, the sidewalls 18*a* and 18*b* have formed thereon a pair of rails 52. The rails 52 are formed by punching out and bending inwardly an elongated piece of sheet metal, the openings 54 resulting from this process. The rails 52 (FIG. 5) extend front to rear across substantially the entire depth of the sidewalls 18*a* and 18*b*. Each rail 52 includes a horizontal central portion 53 which terminates in a downturned lip 55.

The sidewalls 18*a* and 18*b* on the support member 10 are provided with inwardly directed flanges 34, the latter flanges having a plurality of slots 36 formed therein adjacent the four corners of the member 10. These openings are used in combination with similar holes 38 in the cover 13 to couple the support assembly to an overhanging cabinet, as will be discussed hereinafter.

The cover 13 is a generally inverted U-shaped member formed from a relatively light gauge of sheet metal comprising arms 72 which extend downwardly at right angles away from a base or central portion 71. The base 71 is provided with a set of openings 38 which are aligned with the set of slots 36 in the member 10 so that suitable fasteners, such as screws 40, may be inserted therethrough to attach the assembly, including the cover 13 and support member 10, to an overhead cabinet (see FIG. 4). The arms 72 are provided with inwardly directed flanges 74. These flanges 74 serve to hold the cover 13 in contact with the main support assembly when the cover is brought down over the member 10. More specifically, the cover 13 is initially positioned over the member 10 so that the arms 72 thereof straddle the sidewalls 18*a* and 18*b* on the outside thereof with the flanges 74 contiguous with and on the outside of a similar set of flanges 75 on the sidewalls. Aligned holes (not shown) are provided through which screws may be inserted to hold the cover 13 to the member 11. Additional aligned holes may be provided in the flanges 78 of the cover and the backwall for a similar purpose.

The exterior or outside faces of the cover 13 are finished in a conventional manner to provide an acceptable pleasing outward appearance for the arrangement. When assembly, only the exterior surface of the cover 13, the front of the oven module 12 and the plate 42 will be visible, all of these being suitably finished for this reason.

The microwave oven module 12 comprises a unitary structure having a generally box-like appearance. The module 12 includes a frontwardly swingable door 61 (shown in its closed position), which is hingedly supported on the left side thereof and openable by means of a handle 62. A cooking cavity (not shown) is formed behind the door and is generally rectangular in cross-section. The oven module is provided with a control panel 63 which has operator controls for controlling the oven and hood functions (i.e., power, temperature, blower, etc.), as is conventional in the art. The oven module also incorporates a magnetron (not shown) for generating microwaves at a predetermined frequency and waveguides for delivering the microwaves into the interior of the cooking cavity. The construction of the basic operating features of the oven is conventional, and reference may be had to numerous patents in the prior art for detailed information thereon.

The module 12 is generally composed of a sheet metal body 64 in accordance with concurrently-filed application Ser. No. 935,445, , in the name of James A. White, entitled UNITIZED OVEN STRUCTURE FOR A MICROWAVE OVEN, which disclosure is also incorporated herein by reference. That application may be referred to for details of construction for the sheet metal unitized body, which forms no part of this invention, and the details of which are being omitted for the sake of brevity. The sheet metal body 64 has a top wall 65 which is turned upwardly and outwardly at the sides thereof to form two flanges or ledges 50 which define a pair of channels extending front to rear along substantially the entire depth of the module. The flanges 50 are shown in detail in FIGS. 3 and 5 and are seen to comprise a horizontal portion 66 extending outwardly at right angles to the sidewall 65 and a downwardly extending lip 67 integral therewith. The channels defined by the flanges 50 interfit over the rails 52 to thereby permit sliding support of the module 12 on the rails 52.

The main support member 10 also has suitable formations for supporting an exhaust fan assembly (FIG. 2) including a fan 81 located centrally of the member 10 and in air communication with the closure plate 42. The fan assembly is attachable to the support member 10 prior to insertion of the module 12.

A panel or closure plate 42 is provided to close off the bottom wall of the support assembly. The plate 42 includes tabs 46 along the rear edge thereof which interfit with slots 48 along the lower edge of the back wall 14. The front edge of the cover plate 42 has inwardly turned lip 47 which resiliently cooperates with a mating formation on the lower front edge of the module 12 to hold the front of the plate 42 in place.

The plate 42 is provided with appropriate rectangular vent openings 44 having air intake filters positioned therein. Air from above the range heating unit is drawn through these filters and follows an air conduit formed jointly by the module 12 and the support assembly to flow through the combination arrangement and exits at either the opening 64 or the opening 62, as selected upon installation. A more detailed description of the air flow paths through the structure may be had by reference to aforementioned copending application Ser. No. 142,943. Details of these air flow paths have been only briefly described herein for the sake of brevity and the disclosures of the above-noted application is hereby incorporated hereinto by reference.

Figure 3:
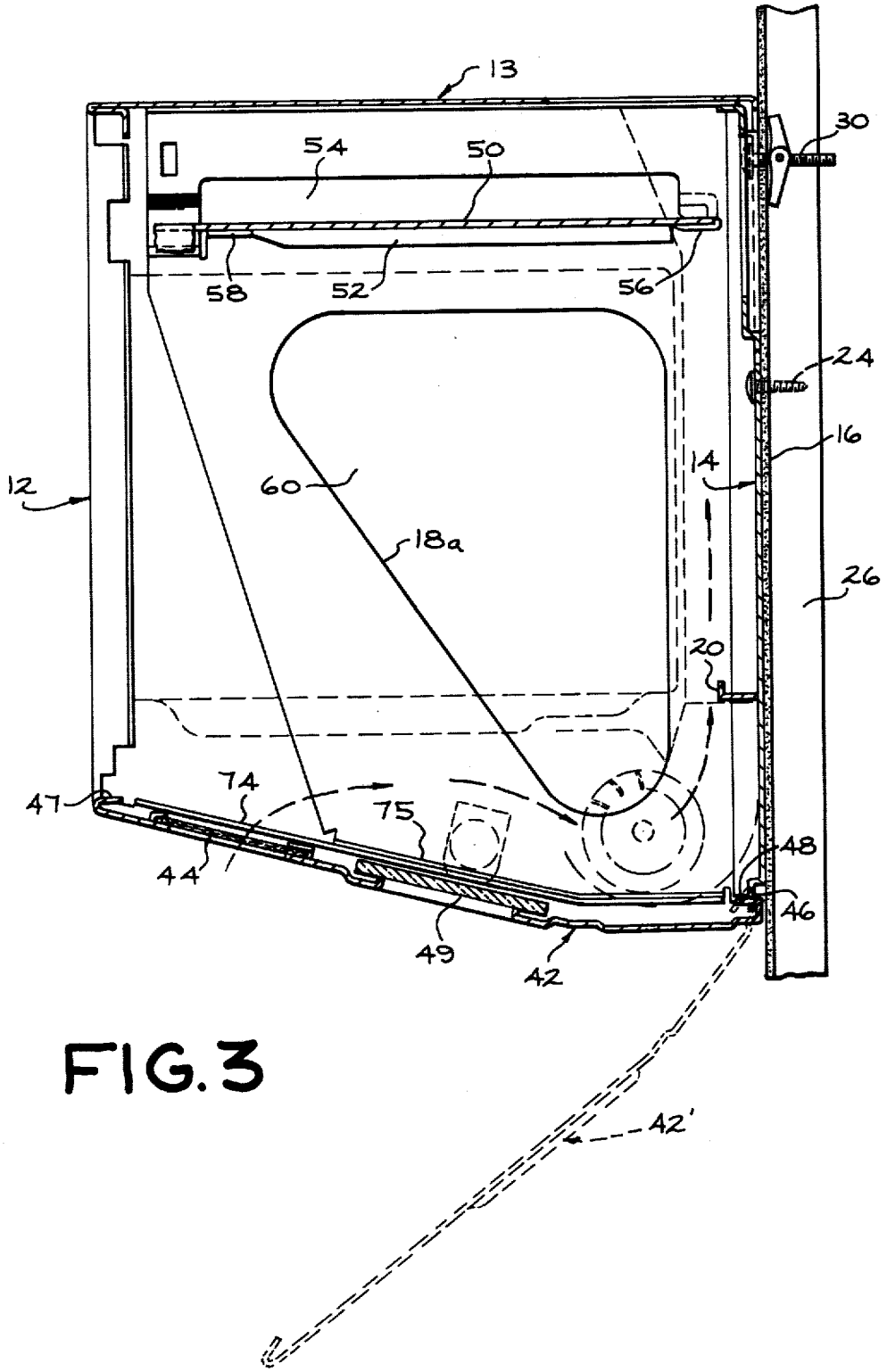
FIG. 3 is a cross-sectional elevation view showing the support assembly structure secured to a vertical wall.

The base plate 42 may also be provided with translucent panel 49 above which light emitting means (not shown) may be positioned to illuminate the range heating surface. The plate 42 is pivotable to an open position 42' as seen in FIG. 3. A plurality of holes (not shown) are provided adjacent the edges of the plate 42 which are aligned with the previously-mentioned holes in the flanges 75 and 74.

Figure 4:
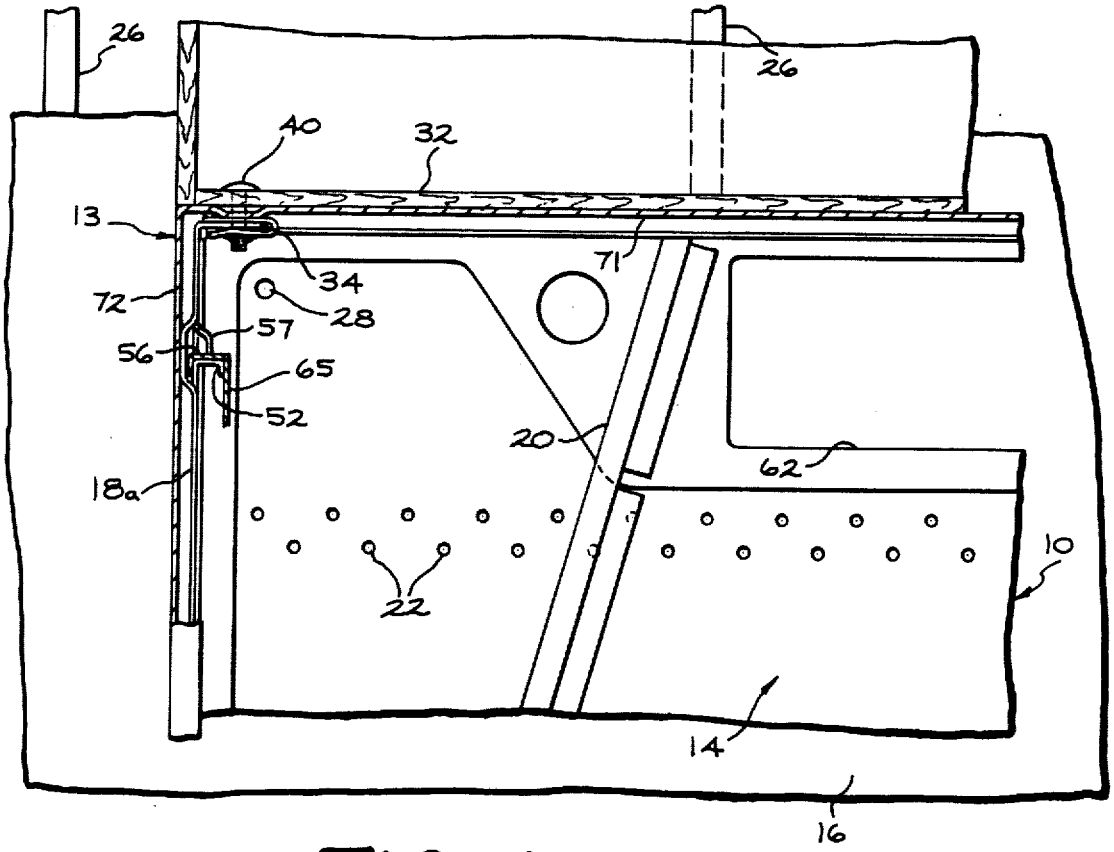
FIG. 4 is a front elevation view, partly in cross section, illustrating the details of the slide structure on which the module is supported during sliding entry into the support assembly and also illustrating the alternative method of support from an overhanging cabinet.
Figure 5:
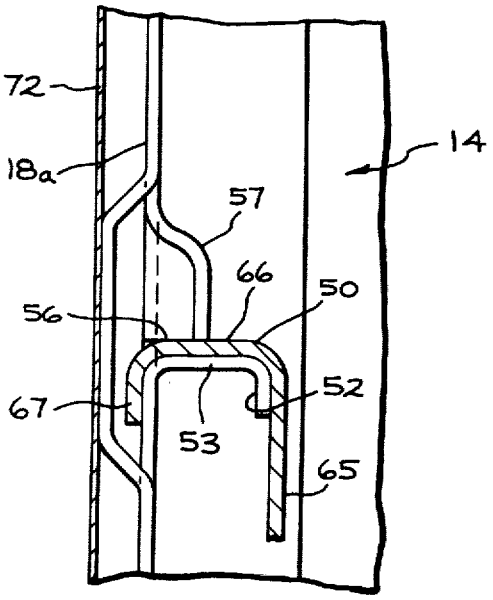
FIG. 5 is an enlarged cross section showing the slide structure of the invention.

The sidewalls **18*a* and 18*b* are provided with tabs 57 located adjacent the rearwardmost end of the rails 52. The tabs extend in a vertical direction from above the rails 52 and terminate in a plane slightly above the plane occupied by the top surface of the rails 52. The space between the tops of rails 52 and the tabs 57 defines gaps or slots 56 into which the rearmost ends of the flanges 50 enter upon full insertion of the module 12 into the support assembly. As best seen in FIGS. 3, 4 and 5, the tabs prevent tilting of the module 12 by closely abutting the tops of the flanges 50 to prevent and upward movement thereof within the assembly 10, as might occur with weight applied to an open oven door. Forward end portions 58 of the rails 52 may be tapered outwardly from the vertical sidewalls 18*a* and 18*b* and rearwardly in the horizontal plane to allow the flanges 50 to be started easily into the member 10. In this manner, binding or catching of the oven 12 as it is started along the rails 52** will be substantially avoided.

The combination microwave oven and vent unit is assembled in the following manner. The support assembly 11 is completed by attaching the cover 13, the plate 42 and the main support member 10 together to form a unitary structure. This is accomplished by positioning the cover 13 over the member 10 with the flanges 74 in contact with the flanges 75, as explained hereinbefore, and the top surface 71 of the cover resting on the flanges 34 and closing off the open top of the support member 10. Screws (not shown) are then inserted through previously-mentioned aligned holes in the flanges 78 and the back wall 14 to attach these two pieces together. The base plate 42 is attached to the cover 13 and support member 10 by passing screws through aligned holes in the flanges 74, 75 and the edges of the plate 42. The resulting structure is a substantially closed, box-like support assembly or enclosure with a front facing opening.

At this point, one of the openings 64 or 62 is closed off by any suitable plate attached thereover. Selection of the appropriate opening to be blocked off is dependent on the exhaust conduit system of the particular installation, i.e. whether a back exhaust opening as shown at 7 of FIG. 1 or a top opening (not shown) is present.

Next, the support assembly is positioned in the space between the cabinets above the range cooktop. The relatively light support assembly is easily handled by a single installer and fixed in place by lag screws through appropriately selected holes 22 in the back wall 14 into the wall standing.

If mounting to a wall stud or to a sufficiently strong vertical wall is not possible, the support assembly may be secured to the floor of an overhead wall cabinet 32 as shown in FIG. 4. This is accomplished by suitable fasteners through the aligned holes 38 in the cover 13 and slots 36 in the member 10 fron the cabinet.

Using either of the above methods the relatively light and easily manageable support assembly is fixed in proper position above the cook top. Then, the microwave oven module is slidably inserted into the front opening by engaging the flanges 50 onto the rails 52 in a manner as shown in FIG. 5 and pushing the module rearwardly into the support assembly until the ends of the flanges 50 pass underneath the tabs 57.

With the module 12 inserted into the support structure, a space is present between the surface 71 of the oven 13 and the top wall of the module 12. Air is circulated through this space as described in the copending application (Docket 9D-RG-13240) noted above. An air permeable grille 91 (FIG. 1) is provided for mounting over the mouth of this space. The grille 91 is mounted by passing fasteners through openings therein (not shown) and also through corresponding flanges (not shown) on the module 12 into the suitable threaded openings on the sidewalls 18*a* and 18*b*. This arrangement, in addition to providing a more pleasing appearance, holds the module 12 in its rearmost position by attaching the module to the support assembly.

Although the subject invention has been described with respect to specific details of a certain preferred embodiment thereof, it is not intended that such details limit the scope of the present invention otherwise than as set forth in the following claims:

What is claimed is:

1. A microwave oven appliance for installation as a separate unit on a vertical wall in an elevated position over a domestic cooking unit comprising:

a unitary microwave oven operating module; and a support assembly, attachable to the vertical wall and adapted to form an enclosure closed except for a front facing opening through which said module is insertable, said assembly including a support member attachable directly to the wall for providing the primary support for said module, said module and member having cooperating support means whereby said module is supported directly by said member within said assembly, said support member comprising a substantially U-shaped bracket having a back wall and side walls extending therefrom, the side walls of said U-shaped bracket directly supporting said module and partly defining said front facing opening into which said module is inserted, said support assembly further including wall means supported by said U-shaped bracket for forming, in combination with said bracket, said enclosure, said side walls of said bracket and said module having cooperating means for slidably receiving said module into said enclosure through said front facing opening and supporting said module within said enclosure.

2. The combination recited in claim 2 wherein said cooperating support means includes rails located on said side walls, and channels located on said module, said channels and rails cooperating such that said module slides into said opening on said rails during said inserting process.

3. The combination recited in claim 2 wherein said wall means includes a cover attachable over said support member on the exterior thereof, said cover having its outward surface finished to provide a conventional appliance exterior finish.

4. The combination recited in claim 3 wherein said enclosure is closed on the bottom thereof by a plate, said plate including an air pervious filter.

5. The combination recited in claim 4 wherein said plate further includes light translucent panels.

6. The combination recited in claim 4 wherein said support member includes formations in the back wall thereof for permitting attachment to a vertical wall.

7. The combination recited in claim 2 wherein the back wall of said U-shaped bracket includes formations for permitting attachment of said member to a vertical wall.

* * * * *